United States Patent [19]

Oka

[11] 4,217,056

[45] Aug. 12, 1980

[54] TYPE ACTION FOR A POWER-DRIVEN TYPEWRITER

[75] Inventor: Hirokazu Oka, Kodaira, Japan

[73] Assignee: Silver Seiko Ltd., Tokyo, Japan

[21] Appl. No.: 928,179

[22] Filed: Jul. 26, 1978

[30] Foreign Application Priority Data

| | | | |
|---|---|---|---|
| Mar. 30, 1978 | [JP] | Japan | 53/036052 |
| Apr. 28, 1978 | [JP] | Japan | 53/057492[U] |
| May 30, 1978 | [JP] | Japan | 53/072335[U] |

[51] Int. Cl.[3] ..... B41J 23/08; B41J 25/02

[52] U.S. Cl. ..... 400/368; 400/377

[58] Field of Search ..... 400/368-372, 400/377, 378

[56] References Cited

U.S. PATENT DOCUMENTS

| | | | |
|---|---|---|---|
| 1,643,041 | 9/1927 | Williams | 400/375.1 |
| 2,307,942 | 1/1943 | Michelsen | 400/379 |
| 3,225,884 | 12/1965 | Krauss et al. | 400/368 |
| 3,322,254 | 5/1967 | Frechette et al. | 400/368 |
| 3,578,128 | 5/1971 | Frechette et al. | 400/379 |
| 3,642,110 | 2/1972 | Hishida et al. | 400/368 |
| 3,738,470 | 6/1973 | Osaka | 400/369 |
| 3,923,136 | 12/1975 | Nakajima | 400/368 |
| 4,016,966 | 4/1977 | Madison | 400/370 |

FOREIGN PATENT DOCUMENTS

| | | | |
|---|---|---|---|
| 2145164 | 3/1973 | Fed. Rep. of Germany | 400/370 |

*Primary Examiner*—William Pieprz

*Attorney, Agent, or Firm*—Armstrong, Nikaido, Marmelstein & Kubovcik

[57] ABSTRACT

A simplified type action for a typewriter comprising a type bar linkage having a toothed driving pawl pivotally mounted on an intermediate lever connected to a type bar through a link, and a key lever linkage including a key lever having a hooked lever pivotally mounted thereon and adapted to be engaged by a blade or tooth on a constantly rotating power or snatch roll to initiate a cycle of printing operation. The trigger lever is yieldably pivotable by the driving pawl upon its return stroke to assure the restoration of the type bar linkage to its normal position. Motion transmitting means best suited for such type action is also disclosed in which the power roll is composed of a center shaft and a toothed member rotatably mounted thereon, and an energy storing motion transmitting spring connects and is adapted to impart the motion of the former to the latter.

7 Claims, 10 Drawing Figures

TYPE ACTION FOR A POWER-DRIVEN TYPEWRITER

BACKGROUND OF THE INVENTION

This invention relates to a type action for a power-driven typewriter and more particularly to a powered type action having a simplified type action construction.

Various attempts have been made to devise a simplified low cost type action for a power-driven typewriter. A successful attempt provides a type action which comprises a pawl coupled by a pin and slot connection to a type bar sublever connected to a type bar by a link and adapted to be pulled into the path of a tooth on a continuously rotated snatch roll in response to key lever depression and driven over an interval determined by the depth of pawl-tooth engagement to drive the sublever for typing operation of the type bar. The pin and slot connection uses a single piece key lever to pull the pawl into engagement with the snatch roll, provides a key lever bypass with economized parts, and also provides initial lost motion between the pawl and the sublever to assure the depth of pawl-tooth engagement of a preset degree. This type action, however, has been found to be imperfect in that the minimum depth of pawl-tooth engagement may cause the pawl to be moved by the snatch roll within a limit defined by the pin and slot lost motion connection between the pawl and the sublever in spite that the pawl is in general inclined to become engaged deeper and deeper with a snatch roll tooth once it is engaged therewith. Thus, the type action has a disadvantage that slow or incomplete depression of a key lever occasionally results in a misfiring or effects no printing of a character.

SUMMARY OF THE INVENTION

Accordingly, an object of the present invention is to provide a simplified type action for a power-driven typewriter which is capable of producing quality of printwork even through slow or incomplete depression of a key lever.

According to the present invention, there is provided a type action which comprises a driving pawl pivotally mounted on a type bar sublever connected to a type bar by a link and a trigger lever pivotally mounted on a key lever and adapted to be engaged with the pawl to bring the same into engagement within the path of a tooth of a continuously rotated toothed power roll and driven thereby to drive the sublever and the type bar for typing operation. The trigger lever is urged by a spring stretched therefrom to the key lever so that it is yieldably pivoted by the pawl when it is engaged by the latter during a return stroke of the latter to its initial position to provide a key lever bypass. According to the invention, the power roll includes a continuously rotated drive shaft, a coaxial toothed member mounted for rotation on and relative to the drive shaft within a limited angle, and an energy storing motion transmitting spring connecting the shaft to the toothed member for accelerating the latter temporarily to a higher rotational speed than would otherwise be obtainable by the drive shaft during actuation thereby of a driving pawl and its associated parts.

Other objects and advantages of the present invention will become apparent from the following detailed description and accompanying drawings of preferred embodiments of the invention.

DESCRIPTION OF THE PREFERRED EMBODIMENTS

Figure 1:
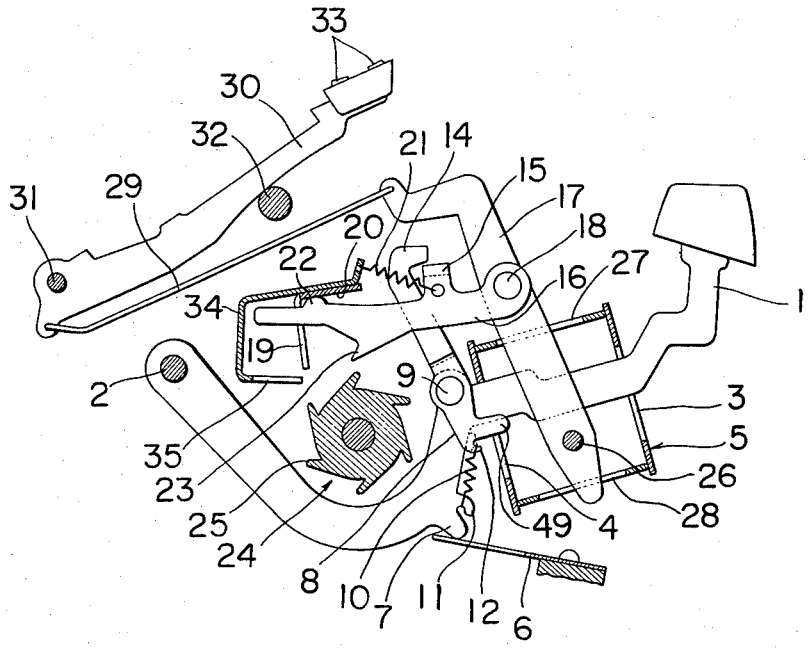
FIG. 1 is a sectional side view of a portion of an electric typewriter embodying the type action according to the present invention, illustrating the type action in a normal position of rest.
Figure 2:
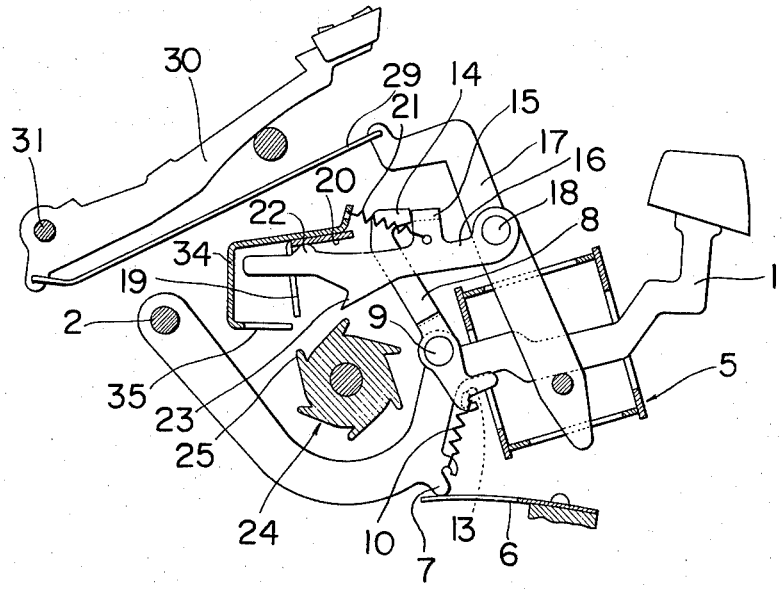
FIG. 2 is a similar view to FIG. 1 illustrating the type action after completion of a cycle of typing operation while a key lever is still depressed.

Referring now FIGS. 1 and 2, there is illustrated a key lever 1 fulcrumed about a cross bar 2 at its rear end and depressible to effect the initiation of a type action. The key lever 1 passes through slots 3 and 4 in a rectangular boxlike sublever mounting bracket generally identified by reference numeral 5, which extends across and is suitably supported on a machine frame. A rearwardly extending flat resilient finger formed on a spring comb 6 mounted on the machine frame underlies an ear 7 formed on each key lever 1 to urge it counterclockwise to a normal rest position in which it is abutted by the upper end of the slot 4. An upwardly extending hooked lever 8 which may preferably be molded with a suitable plastics material is mounted on each key lever 1 at an intermediate portion thereof for pivotal motion about a pin 9 and is urged clockwise by a tension coil spring 10 stretched between lugs 11 and 12 formed on the key lever 1 and the hooked lever 8, respectively. A laterally extending lug 13 (FIG. 2) provided adjacent the lug 12 at the lower end of the hooked lever 8 is abutted by a lower edge portion of the key lever 1 to retain the hooked lever 8 in its initial upright position as illustrated in FIG. 1 against the urging of the spring 10. Adjacent the lug 13, the hooked lower 8 has a leg 49 extending forwardly through the slot 4 of the sublever mounting bracket 5 to be guided therein for pivotal motion about the pin 9. The hooked lever 8 is operatively associated with a type bar linkage and has at its upper end a forwardly extending hook 14 which normally overlies and is adapted to be engaged with a bent lug at the top of an upwardly extending finger 15 formed intermediately of a driving pawl 16 in the type bar linkage.

Each driving pawl 16 is preferably molded with a suitable plastics material such as a polyacetal plastics, and is connected at its forward portion to a sublever or intermediate lever 17 by a pin 18 and passes at its rear end through a vertical slot 19 formed in a guide bracket 20 fixed integrally to an impression control bracket 34 which extends across and is suitably mounted on the machine frame. A spring 21 connects the control bracket 34 to each driving pawl 16 at the finger 15 thereof to urge the driving pawl 16 clockwise about the pin 18 to a rest initial position in which a lobe 22 formed on the upper edge of a rear portion of the pawl 16 is abutted by the lower surface of the horizontal portion of the guide bracket 20. Each driving pawl 16 further has a downwardly extending tooth 23 formed thereon. The tooth 23 of each driving pawl 16 is normally held in a position above and out of engagement with a toothed power roll generally identified by reference numeral 24. The power roll 24, preferably molded with a suitable plastics material, has teeth or blades 25 and is connected by a suitable means to the output shaft of a constantly rotating drive motor (not shown) so that it is driven thereby to constantly rotate clockwise about its axis. Thus, if the driving pawl 16 is pivoted counterclockwise about the pin 18 to bring its tooth 23 into the circular path defined by the teeth 25 of the power roll 24, the tooth 23 is engaged by a tooth 25 of the power roll 24 and the pawl 16 is thereby moved forwardly together with the sublever 17.

Each sublever 17 is pivotally mounted on a cross bar 26 located in the sublever mounting bracket 5 and extends through slots 27 and 28 formed therein which guide the sublever 17 for pivotal motion about the cross bar 26. A connecting link 29 connects the sublever 17 at the top thereof articulately to a type bar 30 fulcrumed about a segment wire 31. Each type bar 30 is normally resting against a type bar rest 32 and is adapted to be driven by the sublever 17 which pivots counterclockwise about the segment wire 31 to bring a character type 33 thereon into contact with a platen (not shown) to print the character on a record medium supported on the platen.

In operation, when a key lever 1 is depressed, the trigger lever 8 thereon causes the hook 14 at its upper end to engage with the bent lug of the associated driving pawl 16 to pivot it counterclockwise about the pin 18 from its initial position thereby bringing its tooth 23 into the circular path defined by the teeth 25 of the power roll 24 to initiate a cycle of power driven operations of the type bar linkage for typing a character. The driving pawl 16 is then driven forwardly by the power roll 24 against the action of the spring 21 to pivot the sublever 17 clockwise about the cross bar 26, whereby the type bar 30 is pivoted through the connecting link 29 counterclockwise about the segment wire 31 thereby effecting printing of the character. During such pivotal motion of the type bar 30, it is first driven by means of the power roll 24 until the tooth 23 of the driving pawl 16 is brought out of engagement with a tooth 25 of the power roll 24, and then continues its pivotal motion by its own inertia. After impact of the character type against the platen, the spring 21 restores the type bar linkage including the driving pawl 16, sublever 17 and type bar 30 to the initial position. Upon such restoration of the driving pawl 16, if the key lever 1 is still held depressed, the hooked lever 8 thereon is contacted at the front end of its hook 14 with the bent lug of the finger 15 of the driving pawl 16 and is pivoted thereby counterclockwise against the action of the spring 10, as illustrated in FIG. 2, thereby assuring the driving pawl 16 and the associated members to resume their initial positions regardless of the depressed key lever 1.

The impression control bracket 34 is provided for controlling the impression of characters to be typed on a record medium carried on the platen. The bracket 34 is provided with adjustable control fingers 35 corresponding to the driving pawls 16. Each control finger 35 underlies a rearward extension of the driving pawl 16 and is adapted to be engaged with the lower edge thereof to limit pivotal motion of the driving pawl 16 thereby limiting the depth of engagement of the tooth 23 of the driving pawl 16 with teeth 25 of the power roll 24. The impression is thus controllable by adjusting the finger 35 of the control bracket 34 since the momentum of the type bar 30 depends on the time or the length of movement of the driving pawl 16 to be driven by the power roll 24 which in turn depends on the depth of engagement.

Figure 3:
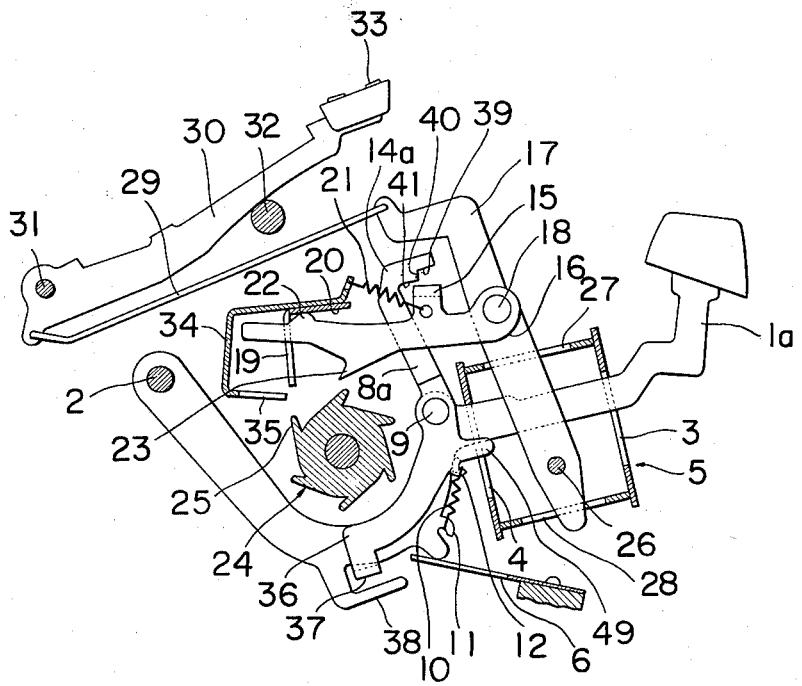
FIG. 3 is a side view illustrating a modified type action in the normal position of rest.
Figure 4:
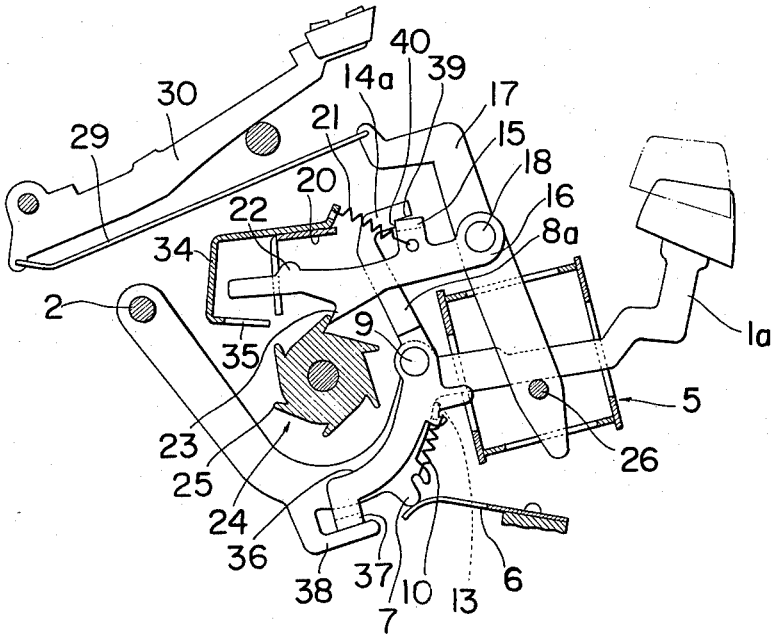
FIG. 4 is a similar view to FIG. 3 illustrating the modified type action after completion of a cycle of typing operation while a key lever is held depressed.

In FIGS. 3 and 4, there is illustrated a modified type action according to which a character is repetitively typed while a modified key lever **1*a* is held depressed. The repeat key lever 1*a* has a reduced height in the cross-section adjacent the cross bar 26 when compared with the non-repeat key levers 1. Since there is more room in the slots 3 and 4, the repeat key lever 1*a* can be depressed rather deeper than those key levers 1 to effect repetitive typing of the corresponding character. Pivotally mounted on the key lever 1*a* is a modified hooked lever 8*a* having a lower extension 36 which extends downwardly along the key lever 1*a* and has a sidewardly extending bent lug 37 formed at the lower end thereof. Adjacent the bent lug 37 of the hooked lever 8*a*, the key lever 1*a* is provided with an adjustable L-shaped finger 38 extending from the lower edge thereof first downwardly and then forwardly, defining a spacing between the lower edge of the key lever 1*a* and the finger 38 thereon. The bent lug 37 of the hooked lever 8*a* is normally located intermediate of the spacing and is adapted to be abutted by the finger 38 when the hooked lever 8*a* is pivoted counterclockwise about the pin 9, thus limiting the pivotal motion of the hooked lever 8*a*. The hooked lever 8*a* has at the top end thereof a modified hook 14*a* which normally overlies and is adapted to be engaged with the bent lug at the top of the finger 15 of the driving pawl 16. The hook 14*a* has a forwardly extending offset portion defining an oblique or inclined edge 39 and a shouldered edge 40 which also overlie the bent lug of the driving pawl 16**.

In operation, depression of the key lever **1*a* initiates a cycle of typing operation in a manner as described above. Upon restoration of the type bar linkage, if the key lever 1*a* is still held depressed to a first non-repeat position, the bent lug at the top of the finger 15 of the driving pawl 16 is engaged with the shouldered edge 40 of the hooked lever 8*a* to pivot the same counterclockwise in a manner as described above thereby preventing repetitive typing of the character. If the key lever 1*a* is held depressed rather deeper to a second or repeat position, however, the bent lug of the driving pawl 16 is brought into engagement with the oblique edge 39 of the hooked lever 8*a* to first pivot the lever 8*a* counterclockwise until the bent lug 37 of the lever 8*a* is abutted by the finger 38 of the key lever 1*a* as particularly illustrated in FIG. 4 and then be cammed by the oblique edge 39 of the hooked lever 8*a* whereby the driving pawl 16 is pivoted counterclockwise about the pin 18 to bring its tooth 23 again into the circular path defined by the teeth 25 of the power roll 24 as illustrated in FIG. 4 thereby initiating another typing operation of the character. Thus, the character is repetitively typed while the key lever 1*a* is held depressed. The finger 38 of the key lever 1*a* is thus adjusted to limit the counterclockwise pivotal motion of the hooked lever 8a such that the tooth 23 of the driving pawl 16 is brought into engagement with a tooth 25 of the power roll 24** at the most appropriate instant during its return stroke to obtain the smoothest stabilized motion thereof for such repetitive typing operations of the character.

Figure 5:
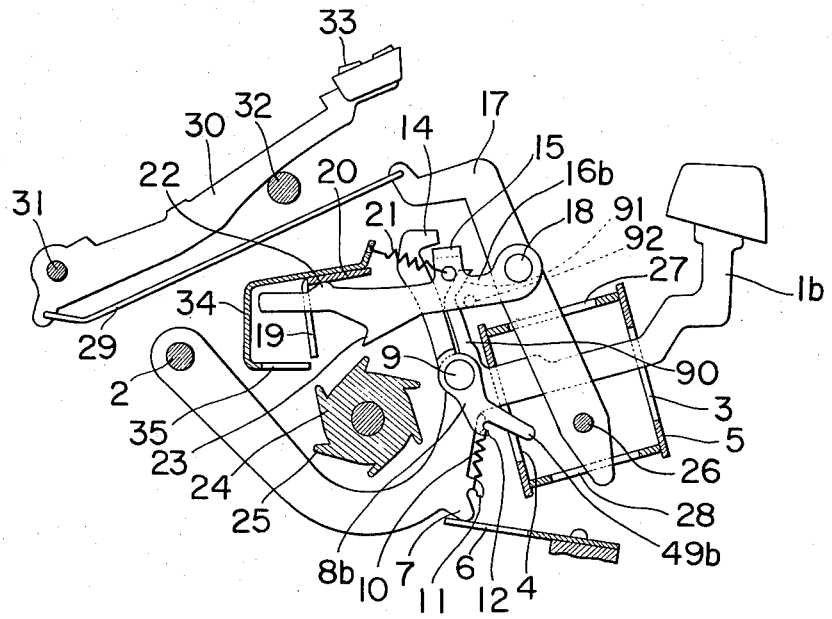
FIG. 5 is a side view illustrating another modified type action in the normal position of rest.
Figure 6:
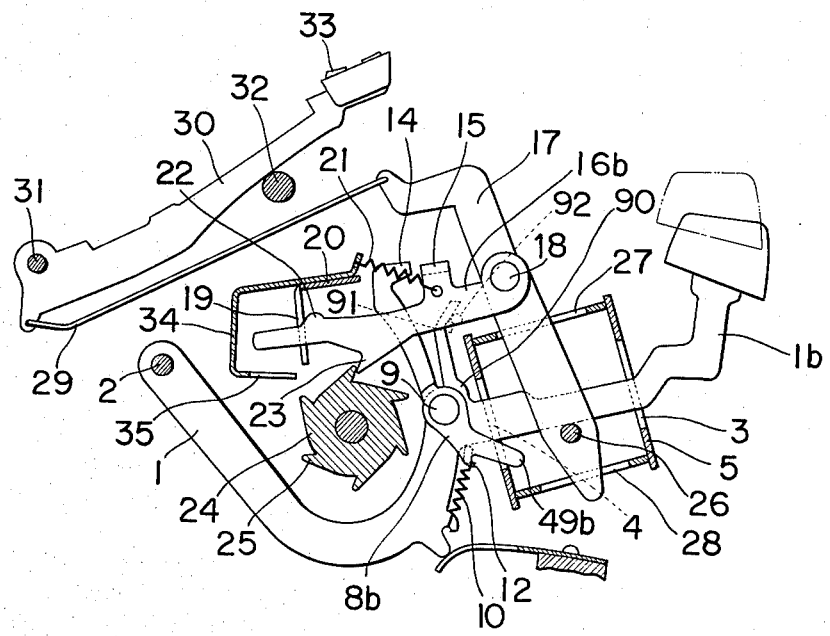
FIG. 6 is a similar view to FIG. 5 illustrating the type action of FIG. 5 after completion of a cycle of typing operation while a key lever is held depressed.
Figure 7:
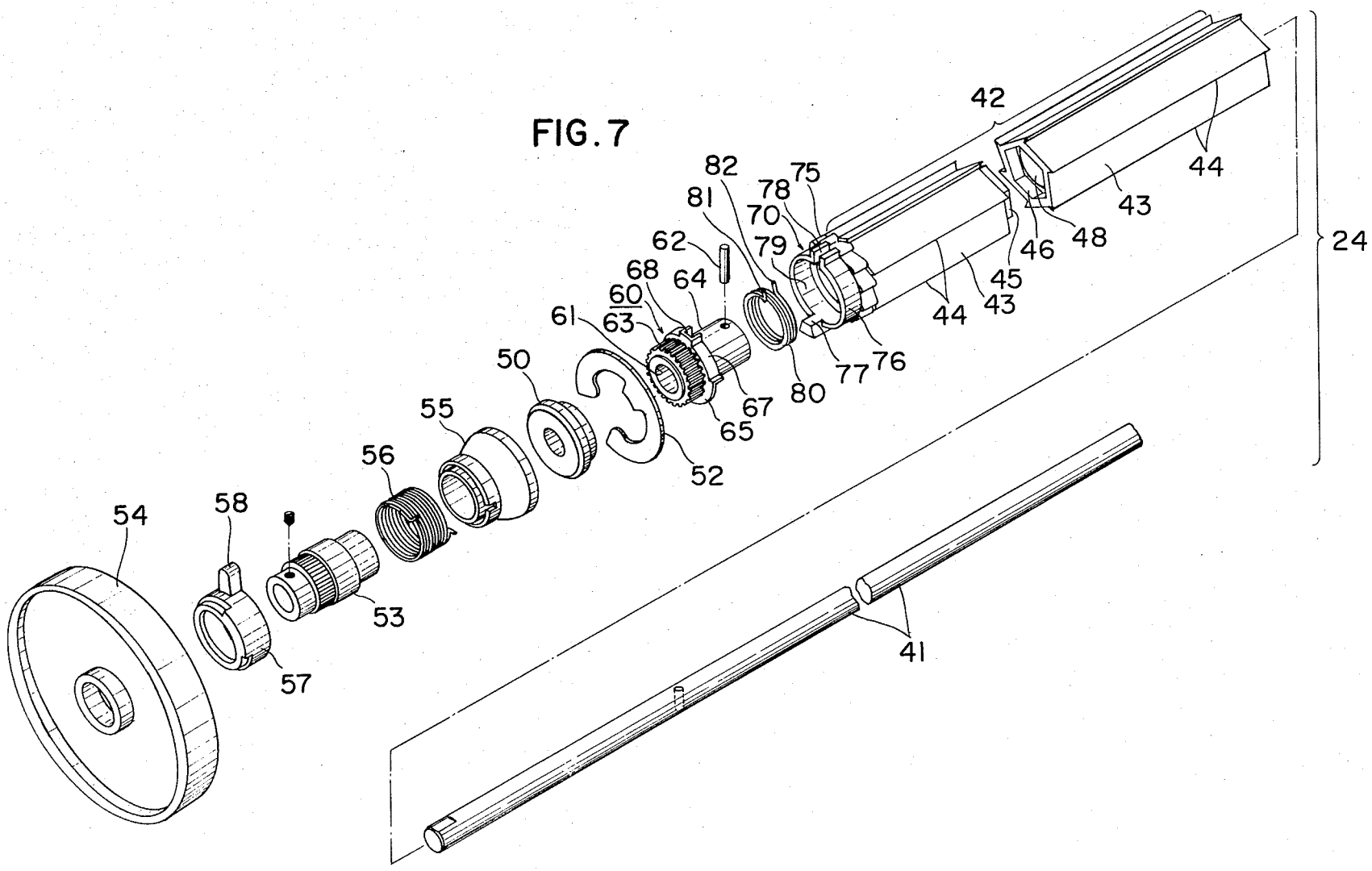
FIG. 7 is an exploded view of the power roll together with a motion transmitting mechanism therefor.
Figure 8:
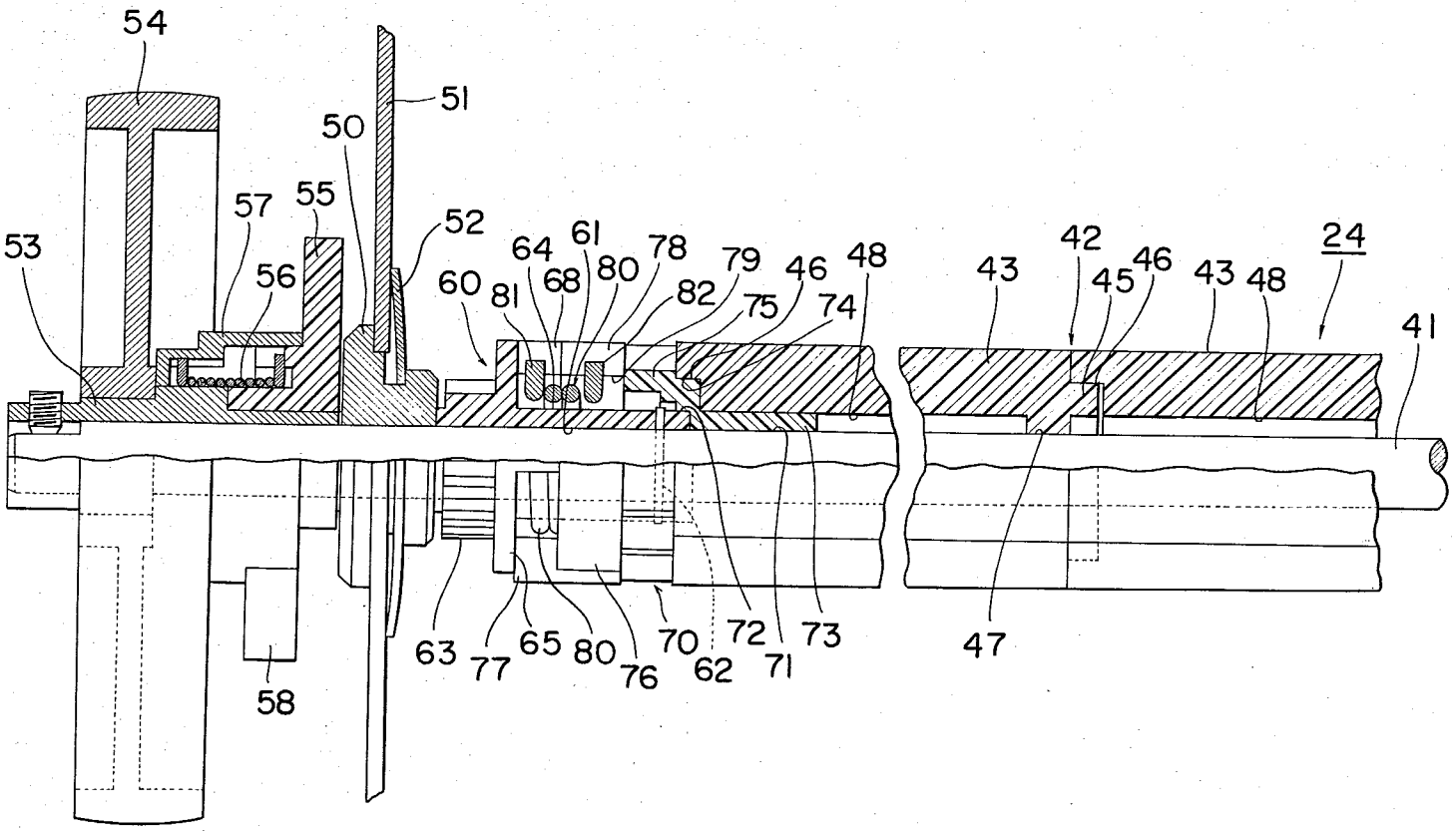
FIG. 8 is a front elevation of the structure of FIG. 7, partly in section.
Figure 9:
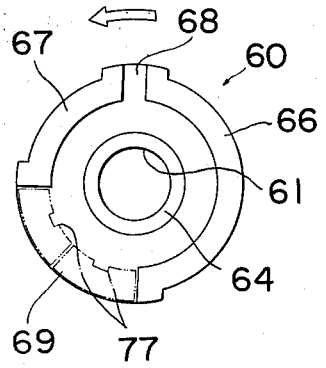
FIG. 9 is an enlarged side elevation of a part of the structure.
Figure 10:
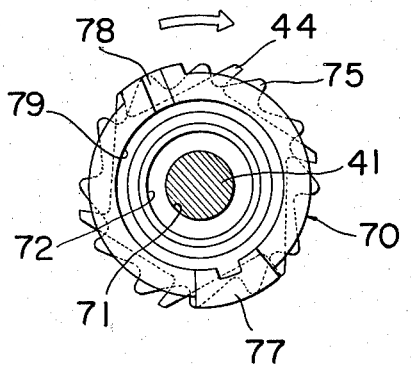
FIG. 10 is an enlarged side elevation of another part of the structure with the power roll.

In FIGS. 5 and 6, there is illustrated another embodiment of a repeat type action according to the present invention. The type action comprises another modified key lever 1b which also has a reduced height adjacent the cross bar 26 as the aforementioned repeat key lever 1a has. The key lever 1b additionally has an adjustable arm 90 provided at the intermediate portion thereof adjacent the pivot 9 for a modified trigger lever 8b. The arm 90 of the key lever 1b extends first upwardly and substantially in parallel with the trigger lever 8b and then obliquely in an upward and forward direction to define a cam surface 91 at its forward edge. A modified driving pawl 16b pivotally mounted on a sublever 17 has a laterally extending lug or cam follower 92 formed integrally thereon in spaced relation to the cam surface 91 of the trigger lever 8b in its normal position of rest. The trigger lever 8b has a modified elongated leg 49b which extends obliquely in a downward and forward direction through the slot 4 of the sublever mounting bracket 5 instead of the forwardly extending leg 49 for any other non-repeat key lever 1. When the key lever 1b is depressed to the deeper second position for repetitive typing, the leg 49b is abutted to the lower end of the slot 4 in the bracket 5 to yieldably pivot the trigger lever 8b counterclockwise about the pin 9 to a pivoted position, as illustrated in FIG. 6, whereby the driving pawl 16b is kept cleared of the trigger lever 8b during depression of the key lever 1b to the second position for repetitive typing.

In operation, depression of the key lever 1b initiates a cycle of typing operation in a manner as described above. Upon restoration of the type bar linkage, if the key lever 1b is still held depressed to the first non-repeat position, the trigger lever 8b is yieldably pivoted by the driving pawl 16b to prevent repetitive typing of the character in a similar manner as in the non-repeat key levers 1. If the key lever 1b is held depressed to the second repeat position, however, the cam follower lug 92 on the driving pawl 16b is brought into engagement with the cam surface 91 on the arm 90 of the key lever 1b to be cammed thereby to bring the tooth 23 of the driving pawl 16b again into the circular path defined by a tooth 25 of the power roll 24 as illustrated in FIG. 6 thereby initiating another cycle of typing operation of the character. Thus, the character is repetitively typed while the key lever 1b is held depressed to the second repeat position. The arm 90 of the key lever 1b may be adjusted in a similar sense as in the finger 38 of the aforementioned key lever 1a.

In FIGS. 7 to 10, there is illustrated a motion transmitting mechanism for imparting power to drive such type bar linkages as described above, which will now be described in detail with reference to FIGS. 7 to 10.

The power roll 24 comprises a center shaft 41 and a toothed member 42 which is mounted for rotation on and relative to the shaft 41 and consists of a plurality of similarly shaped toothed sections 43 preferably molded with a suitable plastics material such as polyacetal plastics. Each section 43 has six teeth or blades 44 formed thereon and a hexagonal extension 45 provided at one end thereof. This extension 45 is received in a hexagonal bore 46 provided at the other end of the adjacent section for affixedly attaching one to another section 43 as seen from FIG. 8. Each section 43 is further provided with a small bore 47 adjacent to the extension 45 for receiving the shaft 41 and also with a larger bore 48 adjacent to the bore 47.

The shaft 41 is supported for rotation at either end portion thereof by a bearing member 50 attached to a side wall 51 of a machine frame by means of a conventional snap ring 52. The shaft 41 extends outwardly beyond the side wall 51 at one end thereof and a hub member 53 is fastened to this end of the shaft 51 by a set screw for rotation with the shaft 51. Affixed to the hub member 53 is a pulley 54 which is connected through a suitable belt (not shown) with another pulley affixed to the output shaft of a drive motor. The power roll 24 is thus continuously rotated. A case shift cam 55 is mounted for rotation on and relative to the hub member 53 and is adapted to be coupled thereto by means of a conventional spring clutch comprising a wrap clutch spring 56 which is connected to the case shift cam 55 at one end and to a timing wheel 57 at the other end. The wheel 57 is loosely mounted on the hub member 53 and has a lug 58 which is normally engaged with a bifurcated clutch trigger (not shown) and is adapted to be released therefrom in response to depression or release of a case shift key (not shown) provided on the typewriter keyboard to couple the case shift cam 55 to the hub member 53 and accordingly to the driving shaft 41 to permit the cam 55 to be rotated a half revolution thereby effecting a case shifting operation.

Motion transmitting means is provided on the shaft 41 between one bearing member 50 and the toothed member 42. It comprises a driving member or first hub member generally identified by reference numeral 60, preferably molded with a suitable plastics material. The hub member 60 is provided with a center bore 61 for receiving the shaft 41 and is affixed thereto by means of a diametrically extending pin 62 for rotation therewith. The hub member 60 has a first knurled sleeve section 63 for operating a knurled cam member (not shown) in response to depression of a space key (not shown) also provided on the keyboard to activate the spacing mechanism of the typewriter to effect feeding of the paper carriage one letter space along the writing line. The hub member 60 has a second sleeve section 64 and a flange portion 65 between the first and second sleeve sections 63 and 64. Axially extending major and minor annular ribs 66 and 67 (FIG. 9) are provided on the flange portion 65 of the hub member 60, thus defining therebetween a slot 68 and an angular or sectoral spacing 69.

A driven member or second hub member generally identified by reference numeral 70 is provided between the first hub member 60 and the toothed member 42. The second hub member 70, also preferably molded with a suitable plastics material, is provided with first and second center bores 71 and 72 for receiving the center shaft 41 and the second sleeve section 64 of the first hub member 60, respectively, for rotation on and relative to them. The second hub member 70 has a first sleeve section 73 and a hexagonal portion 74 which are received in the larger bore 48 and the hexagonal bore 46, respectively, of a toothed section 43 of the toothed member 42 for affixedly coupling the second hub member 70 to the toothed member 42. The second hub member 70 further has an integral toothed wheel section 75 adjacent the hexagonal portion 74 thereof. The wheel section 75 has teeth formed thereon and is adapted to be engaged by known manually operable jam reset means to forcibly rotate the power roll 24 in the reverse direction for freeing jams of typewriter parts such as type bar linkages when the machine is caused to stop by such jams. The second hub member 70 is further provided with a second sleeve section 76 adjacent the wheel section 75 and a lug 77 which extends in parallel with the axis of the center bore 71 thereof into the angular spacing 69 of the first hub member 60. The second sleeve section 76 has a slot 78 formed therein at a position diametrically opposite to the lug 77 and is provided with a center bore 79 having a similar inner diameter with the ribs 66 and 67 of the first hub member 60 as best seen from FIG. 8.

A motion transmitting wrap spring generally identified by reference numeral 80 is provided for coupling the first hub member 60 to the second hub member 70 thereby coupling the driving shaft 41 to the toothed member 42. The wrap spring 80 is located in an annular spacing defined by the annular ribs 66 and 67 of the first hub member 60 and the second sleeve section 76 of the second hub member 70, and has several windings which loosely surround the second sleeve section 64 of the first hub member 60, as seen from FIG. 8. The wrap spring 80 has tabs 81 and 82 at its ends which extend radially to be received within the slots 68 and 78 in the first and second hub members 60 and 70, respectively, and is so arranged that it urges the second hub member 70 to a normal position relative to the first hub member 60 in which position the lug 77 of the second hub member 70 is abutted against the major rib 66 of the first hub member 60. Thus, the toothed member 42 is normally retained in a predetermined angular position relative to the driving shaft 41 by means of the wrap spring 80, but is angularly displaceable against the urging of the wrap spring 80 to a position relative to the driving shaft 41 in which position the lug 77 of the second hub member 70 is abutted against the minor rib 67 of the first hub member 60.

In operation, the toothed member 42 is rotated with normal angular relation to the driving shaft 41 while the power roll 24 has no load applied thereto by any typewriter parts. But, when a key lever 1, 1*a* or 1*b* is depressed and the associated driving pawl 16 or 16*b* is brought into engagement with a tooth 25 of the power roll 24 to initiate the movement of the type bar linkage for typing its character, the toothed member 42 is decelerated thereby so that it is angularly displaced in the reverse direction to the rotation relative to the driving shaft 41 to increase the torsion of the spring 80 whereby energy is stored in the motion transmitting spring 80. As the type bar linkage is gradually accelerated to get a certain speed of movement, the spring 80 will release the energy stored therein to additionally accelerate the type bar linkage so that the linkage finally gets a higher speed than would otherwise be obtained without such energy storage during a period of time of engagement of the type bar linkage by the power roll 24, and the toothed member 42 is restored to its normal position relative to the driving shaft 41 after such release of the stored energy.

What is claimed is:

1. A type action for a power-driven typewriter comprising a pivotally mounted type bar, a pivotally mounted intermediate lever, a link to connect said type bar to said intermediate lever, a toothed power roll, constantly rotating at a normal speed and having teeth at the circumference thereof, a driving pawl pivotally mounted on said intermediate lever and having a tooth disposed to be engageable by a tooth of said power roll to be driven thereby to pivot said intermediate lever and accordingly said type bar in a typing direction to effect typing of the character on said type bar, said driving pawl further having a finger and a sidewardly extending lug formed thereon, a guide bracket for guiding said driving pawl for motion with and on said intermediate lever, means for urging said driving pawl, intermediate lever and type bar to respective normal rest positions in which a tooth of said driving pawl is held cleared of a tooth of the power roll, a spring-urged pivotally mounted key lever depressible to a first position and to a second deeper position, said key lever includes an arm extending upwardly in parallel with and adjacent said trigger lever, and said arm of the key lever has at the upper end thereof a cam portion, a trigger lever pivotally mounted on said key lever and having a hook and a lug formed thereon, a spring stretched between said key lever and said trigger lever to bias the latter to a normal position in which said hook of the trigger lever overlies the top of said finger of the driving pawl, and means for preventing said trigger lever from interfering with said driving pawl when said key lever is in said second position, wherein said driving pawl is pivoted by said trigger lever in response to depression of said key lever to bring said tooth thereon into the circular path defined by said tooth of the power roll to be subsequently engaged by said power roll, said trigger lever is yieldably pivoted when it is engaged at said hook thereof by said finger of the driving pawl during return stroke of said pawl to the normal position, and said cam portion of said arm of said key lever is cleared of said driving pawl lug when said key lever is in the normal rest position or is depressed to the first position and is engaged with said lug of the driving pawl during a return stroke of the latter when said key lever is held depressed to the second position to bring said tooth of said driving pawl into the circular path defined by said teeth of the power roll thereby permitting a repetitive cycle of typing operation to be initiated.

2. A type action as claimed in claim 1 wherein said trigger lever has a laterally extending lug disposed to be engaged with an edge portion of said key lever to retain said trigger lever in the normal position against the biasing of said spring.

3. A type action as claimed in claim 1 further comprising a impression control bracket having an adjustable finger disposed to be engageable with said driving pawl to limit the depth of engagement of said driving pawl tooth with said power roll tooth.

4. A type action as claimed in claim 1 wherein said means for preventing said trigger lever comprises a downwardly extending leg on said trigger lever which is cleared of a fixed element of the typewriter when said key lever is in the normal rest position or is depressed to the first position and which is engaged with said element to yieldably pivot said trigger lever when said key lever is depressed to the second position thereby preventing said hook of the trigger lever from interfering with said driving pawl during a return stroke of the latter.

5. A type action as claimed in claim 1 wherein said power roll includes a constantly rotating drive shaft, a toothed member mounted for rotation on and relative to said drive shaft, and motion transmitting means for imparting rotational motion of said drive shaft to said toothed member to rotate the latter with the former, said means including a driving member affixedly mounted on said drive shaft having an annular sectoral spacing, a coaxial driven member affixedly attached to said toothed member and coupled to said driving member by a lug parallel to said drive shaft coacting with said sectoral spacing such that said driven member is displaceable within a limited angle relative to said driving member and a wrap spring adapted to store energy when a load is applied to said toothed member by the engagement of said driving pawl with a tooth of said toothed member to be decelerated thereby and thereafter release the stored energy to accelerate said toothed member temporarily to a higher rotational speed than the normal rotational speed thereof by urging said driven member to a normal end position from which it is angularly displaced when a load is applied to said toothed member.

6. A type action as claimed in claim 5 wherein said toothed member consists of a plurality of sections each having a center bore formed therein for receiving said drive shaft and a tooth formed thereon, each of said sections having an extension which extends axially from one end thereof and an angular bore formed at the other end thereof for receiving the extension of another section to affixedly attach same thereto, said motion transmitting means further including a hub member having an angular portion which is receivable in said angular bore of one of the sections of the toothed member, said hub member having a slot formed therein for receiving a tab provided at an end of said wrap spring.

7. A type action as claimed in claim 6 wherein said toothed sections and said driving pawls are molded with a suitable plastics material, respectively.

* * * * *